United States Patent [19]

Iida

[11] Patent Number: 4,816,812

[45] Date of Patent: Mar. 28, 1989

[54] METHOD AND SYSTEM FOR DISPLAYING IMAGES IN ADJACENT DISPLAY AREAS

[75] Inventor: Hiroyasu Iida, Ebina, Japan

[73] Assignee: International Business Machines Corporation, Armonk, N.Y.

[21] Appl. No.: 829,880

[22] Filed: Feb. 18, 1986

[30] Foreign Application Priority Data

Apr. 26, 1985 [JP] Japan ..... 60-89089

[51] Int. Cl.[4] ..... G09G 1/14

[52] U.S. Cl. ..... 340/721; 340/724; 340/740

[58] Field of Search ..... 340/721, 724, 726, 727, 340/728, 740, 747

[56] References Cited

U.S. PATENT DOCUMENTS 4,197,590 4/1980 Sukonick et al. ..... 340/726
4,442,495 4/1984 Sukonick ..... 340/726
4,533,910 8/1985 Sukonick et al. ..... 340/721
4,618,858 10/1986 Belch ..... 340/721
4,649,377 3/1987 Urabe ..... 340/721
4,651,146 3/1987 Lucash et al. ..... 340/721

FOREIGN PATENT DOCUMENTS 0092937 12/1978 Japan .

*Primary Examiner*—Gerald L. Brigance
*Assistant Examiner*—Mahmoud Fatahiyar
*Attorney, Agent, or Firm*—Mark S. Walker; J. Dennis Moore

[57] ABSTRACT

A method and apparatus for displaying an image in each of plural display areas that are adjacently defined in a row direction on a display screen having a plurality of display rows, by defining boundary data for determining a boundary in a row direction between each adjacent display areas for each display row, and switching the image display between each adjacent display area for each display row based on the corresponding boundary data for each row, thereby enabling definition of the boundary freely and simply.

3 Claims, 2 Drawing Sheets

METHOD AND SYSTEM FOR DISPLAYING IMAGES IN ADJACENT DISPLAY AREAS

BACKGROUND OF THE INVENTION

1. Field of the Invention

This invention relates to a method and a system for displaying an image on a display screen having a plurality of display rows, and more particularly to a method and a system for displaying an image wherein a boundary in a row direction between adjacent display areas on such display screen can be variably set for each display row.

2. Background Art

In an image display apparatus that is used for an information processing terminal, a plurality of display areas may be defined on the display screen, and an image may be displayed in each display area in order to utilize a limited display screen effectively.

For example, in Japanese Laid-open Patent Specification No. 92937/80, a display screen is constituted by defining in a row direction and in parallel a plurality of display areas having display length of m characters per a row, image information being stored in a screen memory having storage length of m characters per row in the order of display area and of row number, the contents of an address counter being transferred and stored into an auxiliary register when a character counter counts m, and the contents of the auxiliary register being set in the address counter to generate an address for reading the image information stored in the screen memory, thereby displaying an image in each display area.

In such conventional approach, the row display length of the display area is fixed to predetermined m characters for all display rows, and it is required to use specially a screen memory storing predetermined image information and having a storage length which is fixed to m.

Therefore, in the conventional approach, it is impossible to define at will a boundary in row direction between each adjacent display areas, to change the boundary for each display row, and to display image information from a usual refresh buffer memory through windowing.

An object of the invention is to provide an image display method ad its system wherein a boundary in row direction between each adjacent display areas on the display screen can be varied and defined for each display line.

SUMMARY OF THE INVENTION

To that end, the image display method of the present invention provides the steps of storing boundary data defining such boundary for each display row in a boundary information storage means, fetching corresponding boundary data prior to displaying an image for each display row, and switching image displays between each adjacent display areas based on the fetched boundary data for each display row. It is preferable to fetch the corresponding data for each display row after displaying an image for the just preceding display row because it requires simpler means for loading the fetched data.

The image display system of the invention is provided as follows. That is, image information is stored in image information storage. For each display row, a start address in said image information storage for image information to be displayed in each display area is stored in a row information storage. For each display row, boundary data defining a boundary between adjacent display areas is stored in a boundary information storage. The boundary data is appropriately fetched from the boundary information storage to a boundary indicator. The start address is appropriately fetched from the row information storage to an address generator. The address generator generates an address in the image information storage for image information to be displayed in each display area, and switches generation of the address between adjacent display areas under control of the boundary indicator.

It is preferable, but not necessary, to realize the boundary information storage and the row information storage by a row table storage because it can realize both in one storage, and it thus provides a simple and inexpensive configuration. The address generator can be realized simply by, for example, a counter and a register. Similarly, the boundary indicator can be realized simply by, for example, a counter. However, the particular configuration depends upon the choices of the designer.

PREFERRED EMBODIMENT OF THE PRESENT INVENTION

Figure 1:
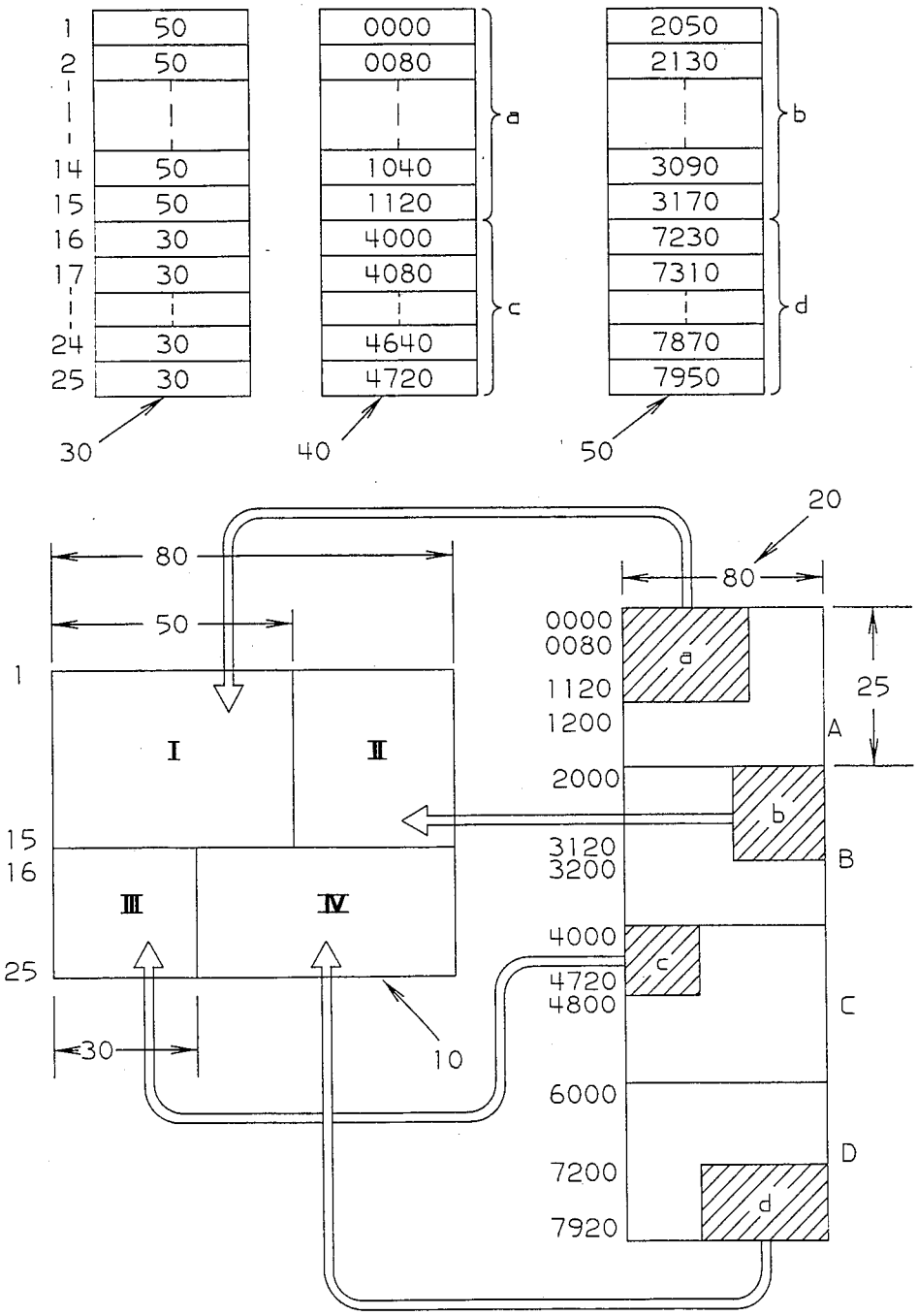
FIG. 1 shows an illustrative diagram of one embodiment of the image display method according to the invention.

FIG. 1 shows an example that the image display method of the invention is applied to a display of λcharacters per a row×25 rows. A refresh buffer memory 20 has image information on images A through D each of which has size of 80 characters per a row×25 rows. Now, it is assumed to select portions a, b, c and d from the image information and to display them on a display screen 10.

Displayed in adjacent areas I and II on the display screen 10, respectively, are the portion a of 50 characters ×15 rows at upper left corner of the image A and the portion b of characters×15 rows at the upper right corner of the image B. Similarly, displayed in adjacent display areas III and IV on the display screen 10, respectively, are the portion c of 30 characters×10 rows at upper left corner of the image C and the portion d of 50 characters×10 rows at the lower right corner of the image D.

The boundary data defining the boundary between each adjacent display areas is stored in a boundary information storage means 30 for each display row. The boundary data is information prescribing number of displayed characters in each display row of the display areas I and III, and information on a display start location on each display row of the display areas II and IV or a location from which column of the display screen 10 the display is started. Thus, when display is made on each display row, the corresponding boundary data is fetched and image display is switched between the adjacent display areas I and II, or III and IV basing on the fetched boundary data. By the way, the boundary information storage means 30 is set with a value of 50 that defines the boundary between the adjacent display areas I and II for the display rows 1 to 15, and a value of 30 that defines the boundary between the adjacent display areas III and IV for the display rows 16 to 25.

In addition, for the adjacent display areas I and III to be first displayed on each display row, a start address for each display row in the refresh buffer memory 20 for the portion a of the image A and the portion c of the image C is stored in a row table storage means 40 storing row information. Addresses 0000, 0080, . . ., 1040, 1120 are set for the display rows 1 to 15 for sequentially displaying the portion a of the image A from the upper left corner, while addresses 4000, 4080, . . ., 4640, 4720 are set for the display rows 16 to 25 for sequentially displaying the portion b of the image B from the upper left corner, while addresses 7230, 7310, . . . , 7870, 7950 are set for the display rows 16 to 25 for sequentially displaying the portion d of the image D from the upper left corner.

It is possible to increase the display areas adjacently defined in a row direction by adding a boundary information storage means and a row information storage means. Since the boundary information storage means is to store row information, it may be realized by a row table storage means. The content stored in the boundary information storage means and the row table storage means depends on software.

Figure 2:
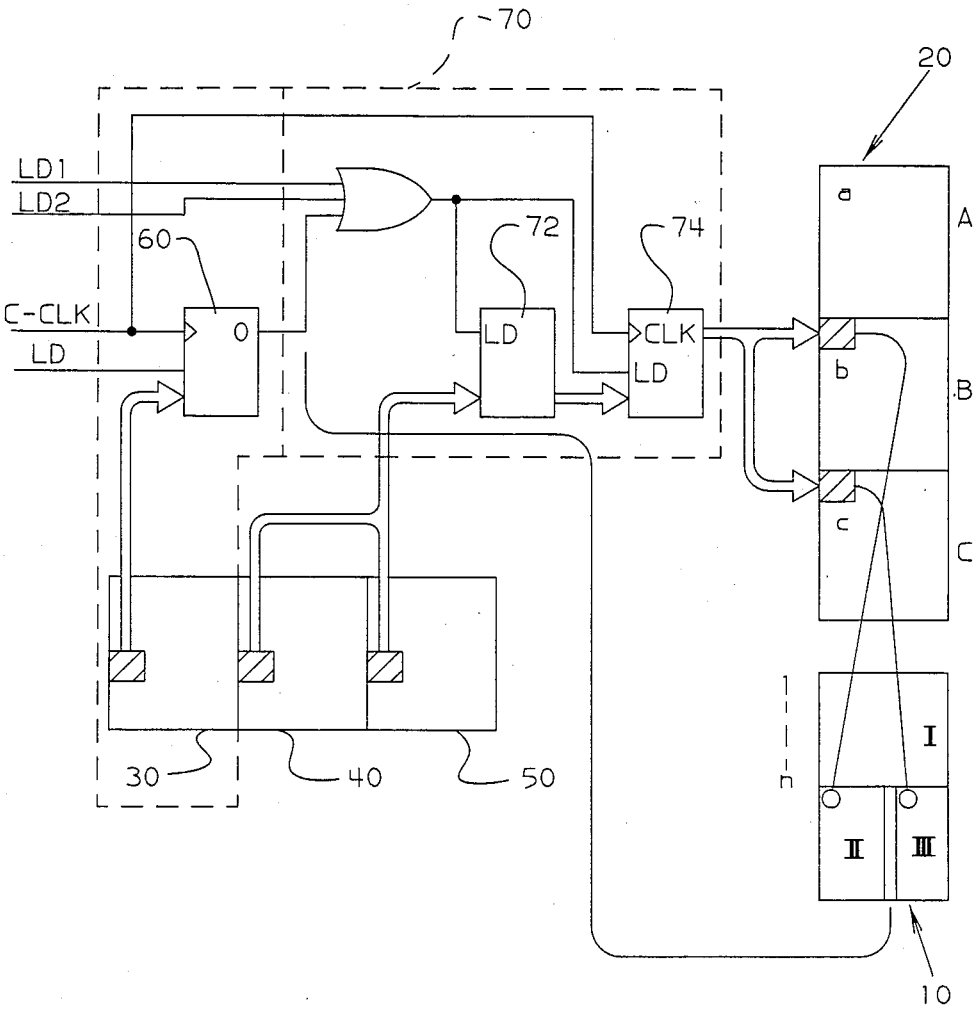
FIG. 2 shows a block diagram of one embodiment of the image display system according to the invention.

FIG. 2 shows an embodiment of the image display system according to the invention. Similar to FIG. 1, FIG. 2 shows the display screen 10, the refresh buffer memory 20, the boundary information storage means 30 and the row table storage means 40 and 50. FIG. 2 shows further a counter means 60 and an address generation means 70. The address generation means 70 is constituted by a register means 72 and a counter means 74.

Now, the operation of the image display system is described. It is assumed here that the portion b of the image B and the portion c of the image C in the refresh buffer memory 20 are displayed in the adjacent display areas II and III from a display row n on the display screen 10.

In fly-back or retrace line after completion of the display row n−1, boundary data defining the boundary between the adjacent display areas II and III, for example 50, is set from the boundary information storage means 30 to the counter means 60. At the same time, the start addresses for the portion b of the image B and the portion c of the image C for the display row n are read from the row table storage means 40 and 50, respectively, the start address for the former and that for the latter being loaded in the counter means 74 and the register means 72, respectively.

When display of the display row n is started, the counter means 60 operates decrementally. When the count reaches 0 from 50, it outputs a timing signal for switching display for the display area II to that for the display area III. On the other hand, the counter means 74 operates to increment the value of start address loaded therein, and generates sequentially addresses following the start address in the portion b of the image B to be displayed on the row n. When the counter means 60 outputs said timing signal, the start address loaded in the register means 72 is transferred to the counter means 74, which generates sequentially addresses following the start address in the portion c of the image C to be displayed on the row n.

Thus, the display in the adjacent display areas II and III is performed on the display row n. Display is similarly performed for succeeding display rows to display the portion b of the image B in the display area II and the portion c of the image C in the display area III, respectively.

Figure 3:
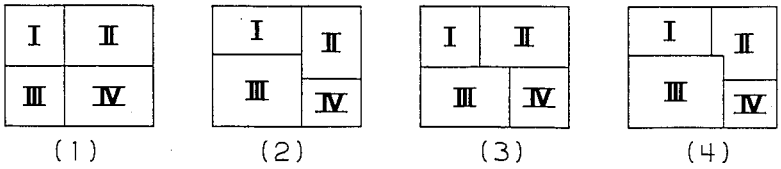
FIG. 3 shows an illustrative diagram of manner dividing the screen.

As described, this invention allows one to define the boundary in a row direction between the adjacent display areas variably for each display row. Therefore, while in the conventional method mentioned earlier, the boundary in a row direction is fixed as shown in FIG. 3 (1) and (2), that is, the display screen can be divided into display areas horizontally only at a position of predetermined column, the invention allows one to freely define a boundary in the direction of row on the display screen as shown in FIG. 3 (3) and (4), that is, the display screen can be divided into display areas horizontally at various column positions.

According to the invention, such image display method can be inexpensive embodied by an image display system with very simple configuration. In addition, since it is not required to prepared image information in a special screen memory as in the above-mentioned conventional method, handling of image information is simple and free, and thus high speed displaying can be attained with simple display operation and a windowing display may be attained.

Thus, while the invention has been described with reference to preferred embodiments thereof, it will be understood by those skilled in the art that various changes in form and details may be made without departing from the scope of the invention.

I claim:

1. A method for displaying an image in each of a plurality of display areas that are adjacently defined in a row direction and in a vertical direction on a display screen having a plurality of display rows, comprising the steps of:

storing boundary data for determining a boundary between row adjacent display areas for each of said plurality of display rows at each entry of a row table storage means;

fetching said boundary data corresponding to each display row to a counter means prior to displaying an image of said each display row;

counting until reaching a boundary value in said fetched boundary data, the number of display elements in the corresponding row for the display area associated with said boundary value; and switching the image display between adjacent display areas for each display row in response to completion of said counting step based on said fetched boundary data.

2. A method as claimed in claim 1 wherein said corresponding boundary data is fetched for each display row after displaying an image for the just preceding display row.

3. A system for displaying an image in each of plural display areas that are adjacently defined in a row direction and in a vertical on a display screen having a plurality of display rows, comprising:

image information storage means for storing image information;

first row table storage means for storing for each display row at each entry a start address in said image information storage means for image information to be displayed in each display area;

second row table storage means for storing for each display row at each entry boundary data defining a boundary between row adjacent display areas;

first counter means in which said boundary data is loaded for indicating said boundary;

register means for storing said start address; and second counter means, connected to said register means, for generating an address in said image information storage means for image information to be displayed in each display area and for switching generation of said address between each adjacent display area under control of said first counter means.

* * * * *